US009297282B2

(12) United States Patent
Byrd et al.

(10) Patent No.: US 9,297,282 B2
(45) Date of Patent: Mar. 29, 2016

(54) CAM PHASER SYSTEM AND METHOD

(71) Applicant: Ford Global Technologies, LLC, Dearborn, MI (US)

(72) Inventors: Kevin Durand Byrd, Royal Oak, MI (US); Jamie Charles Hanshaw, South Lyon, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 52 days.

(21) Appl. No.: 13/895,212

(22) Filed: May 15, 2013

(65) Prior Publication Data

US 2014/0338617 A1 Nov. 20, 2014

(51) Int. Cl.

| | |
|---|---|
| ***F01L 1/34*** | (2006.01) |
| ***F01L 1/344*** | (2006.01) |
| *F01L 1/047* | (2006.01) |
| *F01L 1/053* | (2006.01) |

(52) U.S. Cl.

CPC ..... *F01L 1/344* (2013.01); *F01L 2001/0475* (2013.01); *F01L 2001/0537* (2013.01); *F01L 2001/34496* (2013.01)

(58) Field of Classification Search

CPC ..... F01L 2001/34489; F01L 2001/34496; F01L 1/3442; F01L 2001/34486; F01L 2001/34493

See application file for complete search history.

(56) References Cited

U.S. PATENT DOCUMENTS

| | | | | |
|---|---|---|---|---|
| 2012/0160197 | A1* | 6/2012 | Matsunaga et al. | 123/90.15 |
| 2012/0222637 | A1* | 9/2012 | Neal | F01L 1/26 123/90.17 |
| 2013/0025403 | A1 | 1/2013 | Wigsten | |

* cited by examiner

*Primary Examiner* — Thomas Denion
*Assistant Examiner* — Daniel Bernstein
(74) *Attorney, Agent, or Firm* — Greg Brown; Alleman Hall McCoy Russell & Tuttle LLP

(57) ABSTRACT

An engine system is provided. The engine system includes a drive component coupled to a first end of a camshaft and mechanically coupled to a crankshaft and a cam phaser coupled to a second end of the camshaft and mechanically coupled to and spaced away from the drive component, the cam phaser configured to alter the timing of the camshaft.

19 Claims, 4 Drawing Sheets

CAM PHASER SYSTEM AND METHOD

FIELD

The present disclosure relates to a cam phaser system in an engine and method for operation of a cam phaser system.

BACKGROUND AND SUMMARY

Vehicle profiles may be reduced to decrease vehicle size and mass. At the same time the relative size of engine compartments may be reduced to help improve crash ratings, fit improved suspension packages and larger wheels, and/or improve cabin room. However, while vehicle size may be reduced additional technologies may be added to engines to improve fuel economy, performance, and emissions. Consequently, packaging may be a central issue in the engine design process. One such technology which may improve fuel economy, performance, and emissions are cam phaser systems configured to change relative timing of valve actuation and piston reciprocation. Several types of camshaft phasers may be used for mechanical control of the valvetrain such as electric controlled, oil controlled, or cam torque controlled.

US 2013/0025403 discloses a camshaft assembly for adjusting the duration of valve lift having a hollow camshaft and a first cam phaser positioned in the middle of the hollow camshaft and a second cam phaser positioned at an end of a camshaft adjacent to a sprocket.

The Inventors have recognized several drawbacks with the camshaft assembly disclosed in US 2013/0025403. Firstly, mounting one of the phaser's adjacent to the sprocket may increase the likelihood of phaser damage during a vehicle impact. Moreover, the cam phasers may interfere with adjacent components due to their positions. Furthermore, it may be difficult to route oil to the cam phaser positioned in the middle of the camshaft.

The Inventors herein have recognized the above issues and developed an engine system. The engine system includes a drive component coupled to a first end of a camshaft and mechanically coupled to a crankshaft and a cam phaser coupled to a second end of the camshaft and mechanically coupled to and spaced away from the drive component, the cam phaser configured to alter the timing of the camshaft. In this way, the phaser and the drive component are positioned at remote locations, thereby reducing the likelihood of phaser damage during a vehicle collision. In one example, the camshaft may be a hollow camshaft at least partially enclosing a phaser driveshaft coupled to the drive component. In this way, the compactness of the engine system is increased, enabling the profile of the engine to be reduced, if desired.

The above advantages and other advantages, and features of the present description will be readily apparent from the following Detailed Description when taken alone or in connection with the accompanying drawings.

It should be understood that the summary above is provided to introduce in simplified form a selection of concepts that are further described in the detailed description. It is not meant to identify key or essential features of the claimed subject matter, the scope of which is defined uniquely by the claims that follow the detailed description. Furthermore, the claimed subject matter is not limited to implementations that solve any disadvantages noted above or in any part of this disclosure. Additionally, the above issues have been recognized by the inventors herein, and are not admitted to be known.

DETAILED DESCRIPTION

An engine system including a drive component (e.g., cam sprocket) spaced away from a cam phaser is disclosed herein. The drive component and cam phaser may be positioned on opposing ends of a camshaft. The engine system may further include a phaser driveshaft coupling the drive component to the cam phaser and extending through a hollow camshaft. In this way, the phaser driveshaft may be internally routed to the drive component. As a result, the cam phaser may be spaced away from the drive component without unduly increasing the engine system's profile. Furthermore, moving the cam phaser away from the drive component may reduce interference of the cam phaser with surrounding components such as Front End Accessory Drive (FEAD) components and belt, and engine mounts. Furthermore, this type of engine system may be particularly useful in front wheel drive applications where powertrain decking from below the vehicle makes clearance to the frame rails with an East-West mounted engine difficult. Rear wheel drive and four wheel drive vehicles may also benefit from a reduction in front of engine package length for improving crash conditions. In one example, the cam phaser may be positioned on a side of the engine adjacent to the transmission and opposing a front side of the engine. In this way, the likelihood of cam phaser damage during front-end vehicle collisions is reduced. As a result, the durability of the engine system is increased.

Figure 1:
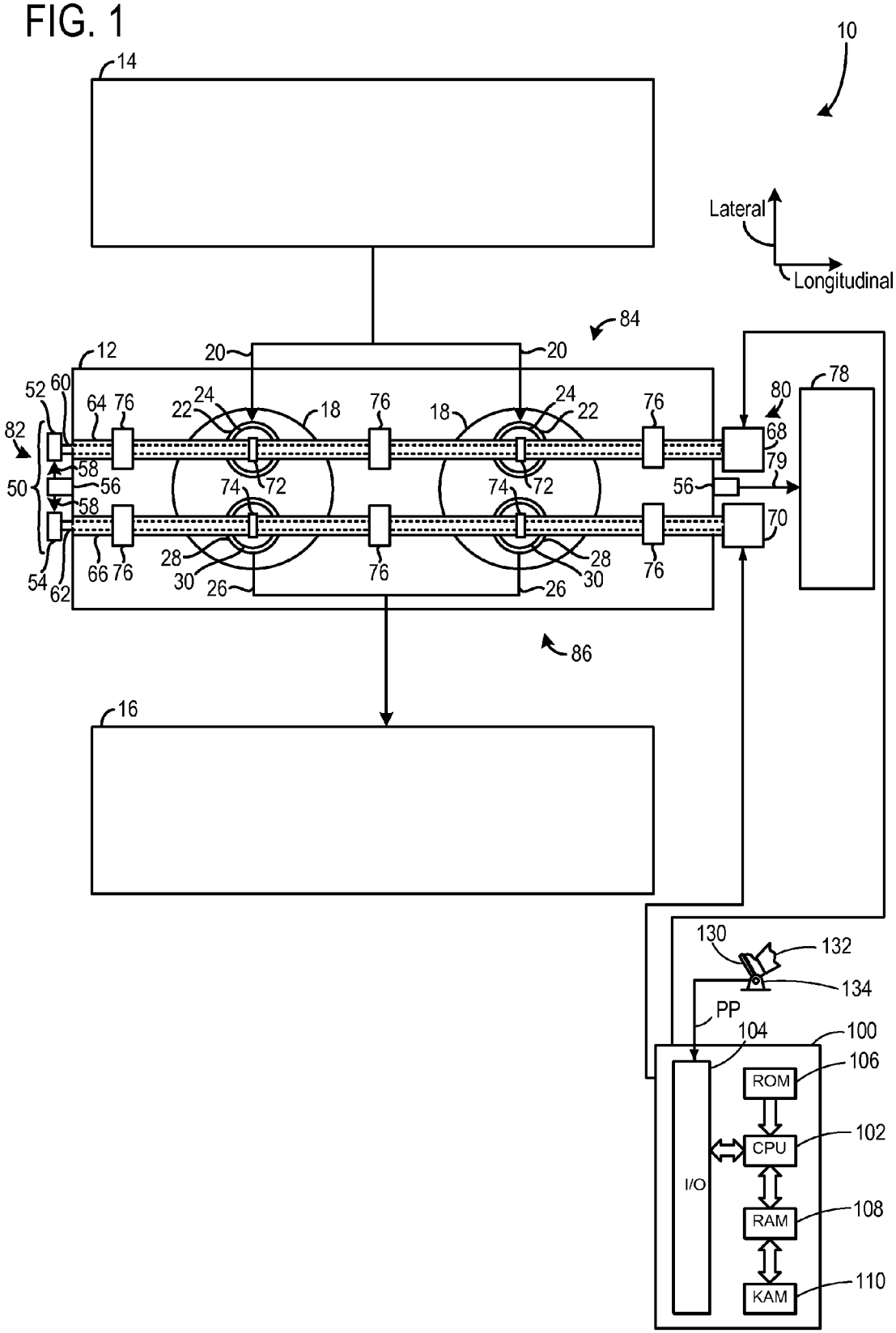
FIG. 1 shows a schematic depiction of a vehicle including an engine and an engine system.

FIG. 1 shows a vehicle 10 including an engine 12 an intake system 14 and an exhaust system 16. The intake system 14 is configured to provide intake air to cylinders 18 in the engine 12. The intake system 14 may include an air filter, throttle, intake conduits, intake manifold, etc. Arrows 20 denote the flow of intake air to intake valves 22 coupled to the cylinders from the intake system 14. The intake valves 22 include tappets 24. The engine is depicted as having two cylinders. However, in other examples the engine 12 may have an alternate number of cylinders and/or another cylinder configuration. For instance, the engine may include four cylinders and/or the cylinders may be arranged in two banks in a V-configuration.

The exhaust system 16 is configured to receive exhaust gas from exhaust valves coupled to the cylinders 18. Arrows 26 denote the flow of exhaust gas from the exhaust valves 28 to the exhaust system 16. The exhaust valves 28 include tappets 30. It will be appreciated that in some examples the exhaust valves 28 may be included in the exhaust system 16. Likewise in some examples the intake valves 22 may be included in the intake system 14. The exhaust system 16 may include one or more emission control devices (e.g., catalysts and/or filters), exhaust conduits, a muffler, an exhaust manifold, etc.

The vehicle 10 further includes an engine system 50. The engine system 50 may be a cam timing adjustment system. The engine system 50 includes a first drive component 52 and a second drive component 54. The drive components (52 and 54) may be camshaft sprockets or other suitable mechanical devices which are configured to receive rotational energy from a crankshaft 56. Arrows 58 denote the transfer of rotational energy from the crankshaft to the drive components (52 and 54). A chain, belt, and/or other suitable mechanical device may be used in this regard.

The engine system 50 further includes an intake phaser driveshaft 60 and an exhaust phaser driveshaft 62. The intake and exhaust phaser driveshafts may be referred to as phaser driveshafts. The intake phaser driveshaft 60 is directly coupled to the drive component 52. Likewise the exhaust phaser driveshaft 62 is directly coupled to the drive component 54. However, in other examples intermediary components may be positioned between the drive components and the phaser driveshafts.

As shown, the intake cam phaser 68 and the exhaust cam phaser 70 are positioned on the same side of the engine. However, in other examples the cam phasers may not be positioned on similar sides of the engine.

The engine system 50 further includes a hollow intake camshaft 64 and a hollow exhaust camshaft 66. The intake phaser driveshaft 60 extends through and is at least partially radially enclosed by the hollow intake camshaft 64. Likewise, the exhaust phaser driveshaft 62 extends through and is at least partially radially enclosed by the hollow exhaust camshaft 66. The phaser driveshafts and camshafts may rotate independently of each other.

The intake phaser driveshaft 60 is directly coupled to an intake cam phaser 68 and the exhaust phaser driveshaft 62 is directly coupled to an exhaust cam phaser 70, in the depicted example. However, in other examples intervening components may be positioned between the cam phasers and the phaser driveshafts.

The intake cam phaser 68 is configured to adjust the relative rotational phase between the intake camshaft 64 and the intake phaser driveshaft 60 to alter (e.g., advance and/or retard) the intake valve timing. Likewise, the exhaust cam phaser 70 is configured to adjust the relative rotational phase between the exhaust camshaft 66 and the exhaust phaser driveshaft 62 to alter (e.g., advance and/or retard) the exhaust valve timing. The cam phasers (68 and 70) may be electronically controlled, in one example. In other examples, the cam phasers may be at least partially controlled via oil. Further in some examples, the cam phasers may at least be cam torque actuated which may use oil pressure to release the locking pin and maintain fluid in the retard and advance chambers, but may also use torque from the cam and lobe signature to generate the phase change.

Intake cam lobes 72 are coupled (e.g., directly coupled) to the hollow intake camshaft 64. Likewise, exhaust cam lobes 74 are coupled (e.g., directly coupled) to the hollow exhaust camshaft 66. The cam lobes are configured to actuate a corresponding intake or exhaust valve. Specifically, the cam lobes may be in face sharing contact with tappets in the valves to facilitate cyclical actuation of the valves.

The hollow intake and exhaust camshafts (64 and 66) are depicted as overhead camshafts in FIG. 1 positioned vertically above the intake and exhaust valves. However, other types of camshafts and actuation systems have been contemplated. For instance, actuation systems including pushrods and overhead valves may be used, in other examples.

Bearing journals 76 are also coupled to the hollow camshafts (64 and 66). The bearing journals 76 provide an interface for camshaft bearing to enable rotation and support of the camshafts. Although three journals are provided per camshaft in the depicted example, an alternate number of journals per camshaft may be included in the engine system 50 in other examples.

A transmission 78 is coupled to crankshaft 56 included in the engine 12. The transmission 78 may be configured to transfer rotational energy generated in the engine to wheels in the vehicle. Arrow 79 denotes the transfer of rotational energy to the transmission from the crankshaft 56. The transmission 78 may include a flywheel, gears, etc.

The engine 12 includes a first side 80 opposing a second side 82. The engine 12 additionally includes a third side 84 opposing a fourth side 86. The first and second sides (80 and 82) may be referred to as lateral sides and the third and fourth sides (84 and 86) may be referred to as longitudinal sides. A longitudinal axis and a lateral axis are provided for reference. The first side 80 of the engine 12 is adjacent to the transmission 78. The intake cam phaser 68 and the exhaust cam phaser 70 are positioned on the first side 80 of the engine 12. The drive components (52 and 54) are positioned on the second side 82 of the engine 12. Thus, the cam phasers and drive components (e.g., sprockets) are positioned on opposing sides of the engine and spaced away from each other. However, in other examples only the intake drive component and the corresponding drive component or the exhaust cam phaser and corresponding drive component may be positioned on opposing sides of the engine.

A controller 100 may be included in the vehicle. The controller 100 may be configured to receive signals from sensors in the vehicle as well as send command signals to components such as the cam phasers (68 and 70) to adjust operation of the components.

Various components in the vehicle 10 may be controlled at least partially by a control system including the controller 100 and by input from a vehicle operator 132 via an input device 130. In this example, input device 130 includes an accelerator pedal and a pedal position sensor 134 for generating a proportional pedal position signal PP. The controller 100 is shown in FIG. 1 as a microcomputer, including processor 102 (e.g., microprocessor unit), input/output ports 104, an electronic storage medium for executable programs and calibration values shown as read only memory 106 (e.g., read only memory chip) in this particular example, random access memory 108, keep alive memory 110, and a data bus. Storage medium read-only memory 106 can be programmed with computer readable data representing instructions executable by processor 102 for performing the methods described below as well as other variants that are anticipated but not specifically listed. As shown, the cam phasers (68 and 70) may receive control signals, indicated via arrow 95, from the controller 100. In this way, the controller can adjust the valve timing via the phasers. As previously, discussed the phasers may be electronically controller, oil controlled, or cam torque controlled.

Figure 2:
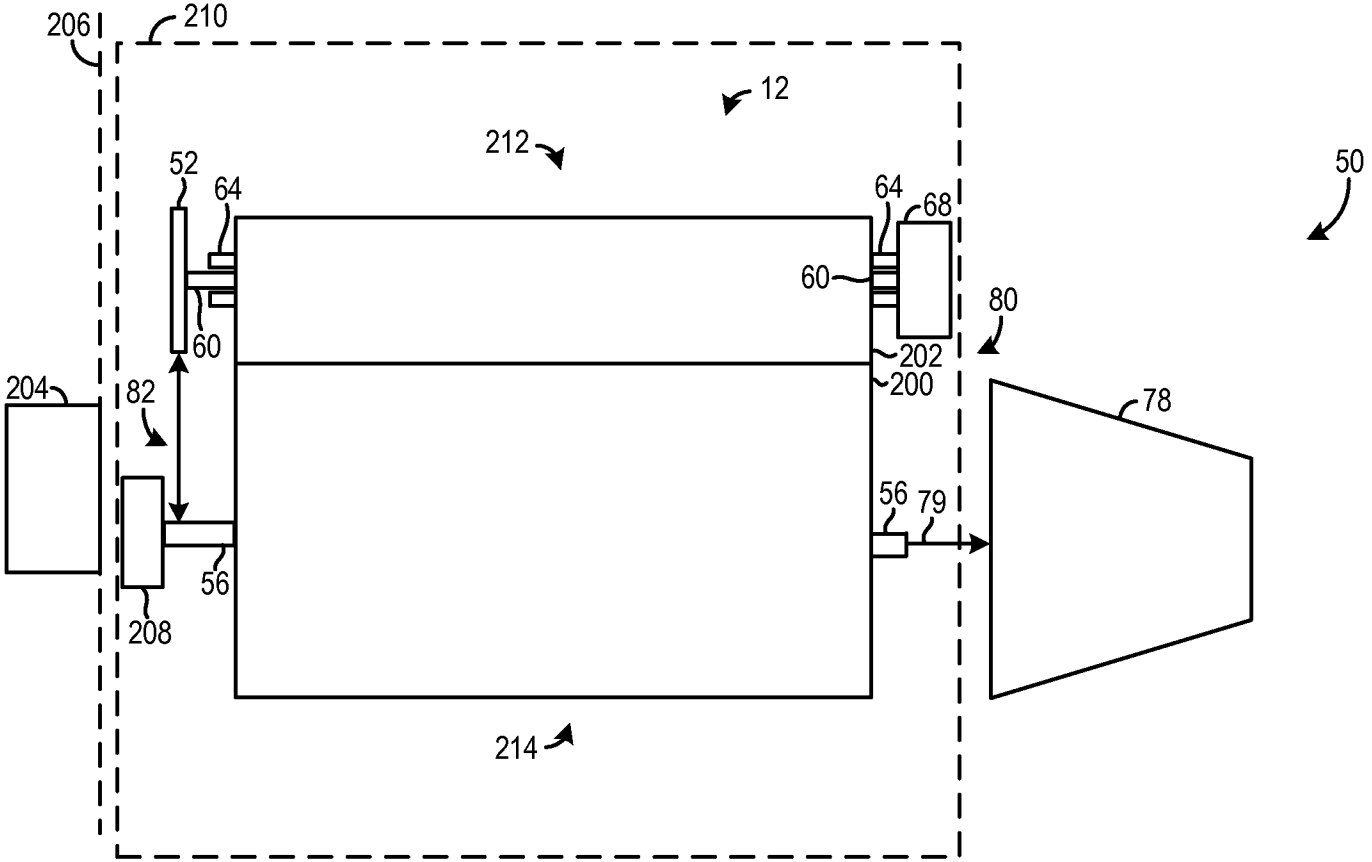
FIG. 2 shows another view of the vehicle, engine, and engine system shown in FIG. 1.

FIG. 2 shows a side view of the engine 12 and engine system 50 shown in FIG. 1. The engine 12 includes a cylinder block 200 coupled to a cylinder head 202. The transmission 78 is also coupled to the engine 12. Specifically, the transmission 78 is rotationally coupled to the crankshaft 56, denoted via arrow 79. The transmission 78 may include various components such as a flywheel, gears, etc. A frame rail 204, generically denoted via a box, is also shown in FIG. 2. A crash or decking zone boundary 206 is also illustrated in FIG. 2. A decking zone may be the space needed for installation of the powertrain to avoid contact with other vehicle components such as frame rails, cooling fans, anti-lock braking system (ABS) brake modules, etc. A crash plane indicates a crushable distance in front of major hard components to allow for energy dissipation in the event of a vehicle crash or contact with foreign object. The hollow intake camshaft 64, intake phaser driveshaft 60, intake cam phaser 68, and drive component 52, are also depicted in FIG. 2. As shown, the intake phaser driveshaft 60 extends through the hollow intake camshaft 64. The drive component 52 is positioned adjacent to the crash zone boundary 206 and the frame rail 204. The cam phaser 68 is spaced away from the crash zone boundary 206 and frame rail 204. In this way, the likelihood of phaser damage during a vehicle crash is reduced. As a result, the durability of the engine system 50 is increased. Placement of the phasers behind the engine, on the back side of the cylinder head, and over the transmission may reduce the likelihood of contact and/or damage in the event of a crash.

A crankshaft damper 208 is also shown coupled to the crankshaft 56. The crankshaft damper 208 is configured to reduce crankshaft vibration (e.g., tortsional crankshaft vibration). The first side 80 of the engine 12 and the second side 82 of the engine 12 are also shown in FIG. 2. The second side 82 may be a front side of the engine and the first side 80 may be a rear side of the engine. The front side may be adjacent to a leading side of the vehicle when the vehicle is traveling in a forward direction. Likewise, the rear side may be adjacent to a vehicle cabin. As shown, the transmission 78 is on the first side 80 of the engine 12 and adjacent to the intake cam phaser 68. The engine system 50 may be enclosed in an engine compartment 210. Specifically, the engine compartment 210 may be an engine compartment in a two wheel drive application, in one example. However, in other examples the engine compartment 210 boundary may enclose different and/or additional components. For instance, the transmission may be included in the engine compartment in a four wheel drive (FWD) application and another box frame rail may be located past the transmission in a FWD application. A top side 212 and a bottom side 214 of the engine 12 are also shown.

Figure 3:
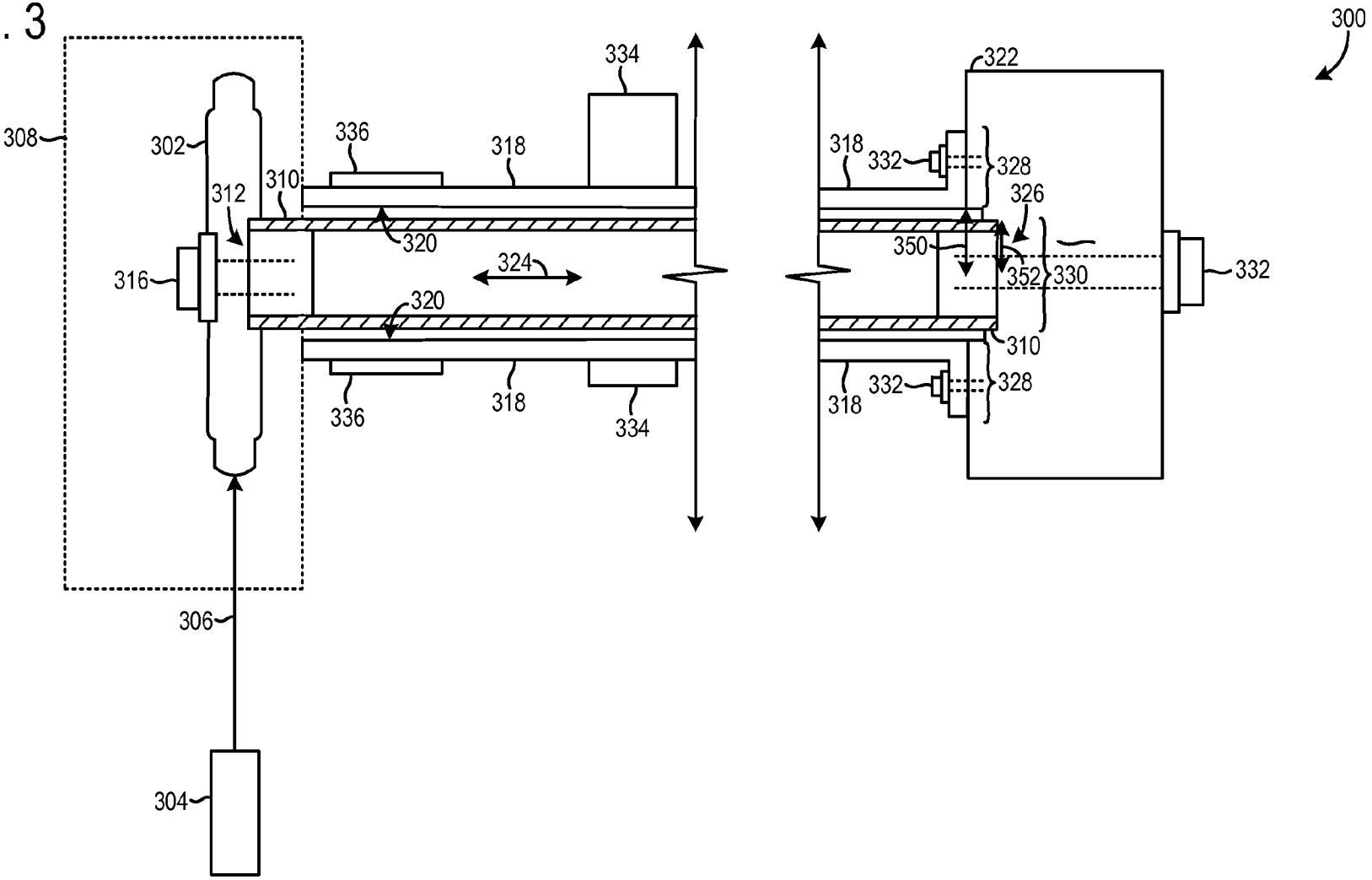
FIG. 3 shows an example engine system.

FIG. 3 shows a cross-sectional view of an example engine system 300. The engine system 300 may be similar to the engine system 50, shown in FIG. 1. The engine system 300 includes a drive component 302 (e.g., sprocket). The drive component 302 is mechanically coupled to a crankshaft 304. The mechanical coupling is denoted via arrow 306. As previously discussed, a suitable component such as a chain, belt, etc., may be used to enable the aforementioned mechanical coupling. The drive component 302 is at least partially enclosed by a front engine cover 308.

The engine system 300 further includes a phaser driveshaft 310. The phaser driveshaft 310 includes a first end 312 coupled to the drive component 302. It will be appreciated that the phaser driveshaft 310 may be an intake phaser driveshaft or an exhaust phaser driveshaft. A bolt 316 is used to couple the phaser driveshaft 310 to the drive component 302, in the depicted example. However, other suitable coupling techniques have been contemplated such as welding, press fitting, etc. The bolt 316 is shown extending into the phaser driveshaft 310.

The phaser driveshaft 310 is shown extending through and at least partially enclosed by a hollow camshaft 318. The hollow camshaft 318 may be an intake camshaft or an exhaust camshaft. As shown, the phaser driveshaft 310 is radially spaced away from an interior surface 320 of the hollow camshaft 318. In this way, the phaser driveshaft 310 and the hollow camshaft 318 may rotate independently of one another, if desired. In other words, the phaser driveshaft 310 and the hollow camshaft 318 are not directly rotationally coupled to one another.

The engine system 300 further includes a cam phaser 322. It will be appreciated that the cam phaser 322 is configured to alter the phase between the phaser driveshaft 310 and the hollow camshaft 318 to advance and/or retard valve timing. In this way, the valve timing may be adjusted based on engine operating conditions. Thus, the phaser driveshaft 310 and the hollow camshaft 318 may rotate out of phase, if desired. Additionally, the phaser driveshaft 310 and the hollow camshaft 318 may rotate about the same axis in some examples. A rotational axis 324 of the phaser driveshaft 310 and the hollow camshaft 318 is depicted. However, in other examples the axes of rotation of the camshaft 318 and the phaser driveshaft 310 may not be similar.

The phaser driveshaft 310 may comprise steel, aluminum, or cast iron. The hollow camshaft 318 may comprise steel, aluminum, or cast iron. In some examples, the phaser driveshaft 310 and the hollow camshaft 318 may comprise different materials or composite.

The phaser driveshaft 310 includes a second end 326 coupled to the cam phaser 322. The cam phaser 322 includes a phaser driveshaft interface 328 and a camshaft interface 330. The phaser driveshaft interface 328 and the camshaft interface 330 are axially aligned. An inner radius 350 of the camshaft interface 330 is greater than an outer radius 352 of a phaser driveshaft interface 328.

The phaser driveshaft interface 328 is directly coupled to the second end 326 of the phaser driveshaft 310. The camshaft interface 330 is directly coupled to the hollow camshaft 318. Both the interfaces in the cam phaser are coupled to their respective components via bolts 332. However, other suitable attachment techniques have been contemplated.

The cam phaser 322 is configured to adjust the relative phase between the phaser driveshaft 310 and the hollow camshaft 318 to alter valve actuation timing. The hollow camshaft 318 includes a cam lobe 334 and a cam journal 336. It will be appreciated that additional cam lobes and cam journals may be included in the hollow camshaft 318. Specifically in one example each cylinder in the engine may have at least one corresponding cam lobe. The cam lobe 334 is configured to cyclically actuate a valve (e.g., intake valve or exhaust valve). Thus, the cam lobe 334 may be in direct contact with a valve tappet. Moreover, the cam lobe 334 and the cam journal 336 interpose the drive component 302 and the cam phaser 322.

Figure 4:
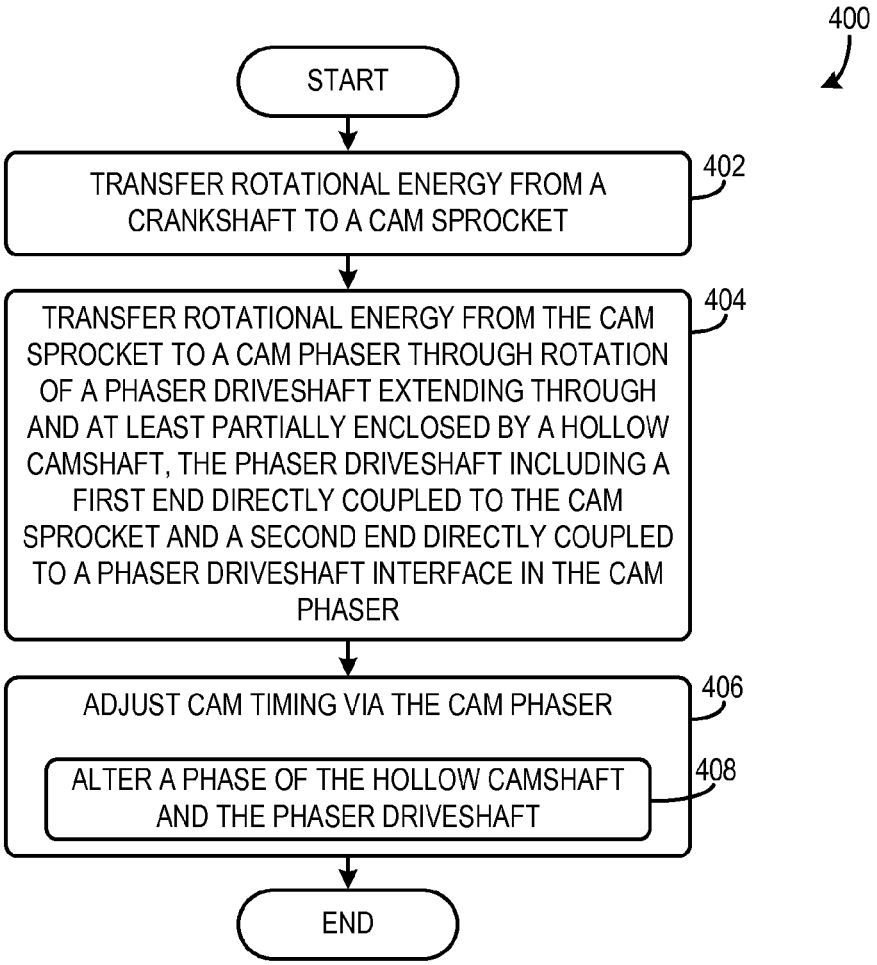
FIG. 4 shows a method for operation of an engine system.

FIG. 4 shows a method 400 for operation of an engine system (e.g., cam phaser system). The method 400 may be implemented via the engine system discussed above with regard to FIGS. 1-3 or may be implemented via another suitable engine system.

At 402 the method includes transferring rotational energy from a crankshaft to a cam sprocket. Next at 404 the method includes transferring rotational energy from the cam sprocket to a cam phaser through rotation of a phaser driveshaft extending through and at least partially enclosed by a hollow camshaft, the phaser driveshaft including a first end directly coupled to the cam sprocket and a second end directly coupled to a phaser driveshaft interface in the cam phaser. At 406 the method includes adjusting cam timing via the cam phaser. Adjusting the cam timing via the cam phaser may include adjusting cam timing includes altering a phase of the hollow camshaft and the phaser driveshaft at 408. In one example, the cam phaser is adjacent to a transmission. In this way, rotational energy from the crankshaft may be routed to a cam phaser through a phaser driveshaft extending through a hollow camshaft. As a result, the compactness of the engine system is increased. Moreover, the cam phaser is spaced away from the cam sprocket reducing the likelihood of cam phaser damage from vehicle impacts.

Note that the example control and estimation routines included herein can be used with various engine and/or vehicle system configurations. The specific routines described herein may represent one or more of any number of processing strategies such as event-driven, interrupt-driven, multi-tasking, multi-threading, and the like. As such, various actions, operations, and/or functions illustrated may be performed in the sequence illustrated, in parallel, or in some cases omitted. Likewise, the order of processing is not necessarily required to achieve the features and advantages of the example embodiments described herein, but is provided for ease of illustration and description. One or more of the illustrated actions, operations and/or functions may be repeatedly performed depending on the particular strategy being used. Further, the described actions, operations and/or functions may graphically represent code to be programmed into non-transitory memory of the computer readable storage medium in the engine control system.

It will be appreciated that the configurations and routines disclosed herein are exemplary in nature, and that these specific embodiments are not to be considered in a limiting sense, because numerous variations are possible. For example, the above technology can be applied to V-6, I-4, I-6, V-12, opposed 4, and other engine types. The subject matter of the present disclosure includes all novel and non-obvious combinations and sub-combinations of the various systems and configurations, and other features, functions, and/or properties disclosed herein.

In one example embodiment, a cam phaser system includes a cam sprocket rotationally coupled to a phaser driveshaft extending through and at least partially radially enclosed by a hollow camshaft; and a cam phaser coupled to the phaser driveshaft via a phaser driveshaft interface and coupled to the hollow camshaft via a camshaft interface. The cam phaser and the cam sprocket may be positioned on opposing ends of the hollow camshaft, without any other sprocket and/or cam adjustment mechanisms therebetween. The hollow camshaft and the phaser driveshaft may not be directly rotationally coupled to one another. The hollow camshaft may have an unfilled void therein that extends, in an uninterrupted and unbroken fashion, an entire length from the sprocket to the cam phaser. The hollow camshaft may support external cams driving not only cylinder valves, but also a high pressure fuel pump driving direct fuel injection injectors coupled to the engine cylinders. The cams may include cam lobes driving a plurality of intake valves. The cams may include cam lobes driving a plurality of exhaust valves. The sprocket may be coupled to a chain drive via teeth. The sprocket may be coupled to a band via a smooth outer surface of the sprocket. The cam may be a camshaft of a dual overhead camshaft system. In other embodiments, the camshaft may include externally mounted cylinder valve deactivation mechanisms between the sprocket and cam phaser.

The following claims particularly point out certain combinations and sub-combinations regarded as novel and non-obvious. These claims may refer to "an" element or "a first" element or the equivalent thereof. Such claims should be understood to include incorporation of one or more such elements, neither requiring nor excluding two or more such elements. Other combinations and sub-combinations of the disclosed features, functions, elements, and/or properties may be claimed through amendment of the present claims or through presentation of new claims in this or a related application. Such claims, whether broader, narrower, equal, or different in scope to the original claims, also are regarded as included within the subject matter of the present disclosure.

The invention claimed is:

1. An engine system comprising:

a drive component directly coupled to a first end of a phaser driveshaft and mechanically coupled to a crankshaft;

a cam phaser coupled to a second end of a camshaft and mechanically coupled to and spaced away from the drive component, the cam phaser configured to alter a timing of the camshaft; and the phaser driveshaft extending an entire length of the camshaft, a second end of the phaser driveshaft coupled to the cam phaser and mechanically coupled to the drive component, wherein the cam phaser and the drive component are positioned on opposing ends of the camshaft, without any other sprocket and cam adjustment mechanisms therebetween.

2. The engine system of claim 1, wherein the camshaft is a hollow camshaft, and wherein the second end of the phaser driveshaft is directly coupled to the cam phaser via a phaser driveshaft interface and is at least partially enclosed by the hollow camshaft.

3. The engine system of claim 2, further comprising a cam lobe and a cam journal included in the camshaft.

4. The engine system of claim 2, where the second end of the hollow camshaft is directly coupled to a camshaft interface included in the cam phaser.

5. The engine system of claim 4, where an inner radius of the camshaft interface is greater than an outer radius of the phaser driveshaft interface.

6. The engine system of claim 2, where the phaser driveshaft is radially spaced away from the hollow camshaft.

7. The engine system of claim 1, the camshaft being a first camshaft, further comprising a second camshaft, where the first and second camshafts are overhead camshafts including one or more cams in direct contact with a valve tappet, the first camshaft being configured to actuate one or more intake valves and the second camshaft being configured to actuate one or more exhaust valves.

8. The engine system of claim 1, where at least one cam lobe and cam journal axially interpose the drive component and the cam phaser coupled to the camshaft.

9. The engine system of claim 1, where the cam phaser is positioned on a first side of the engine adjacent to a transmission and the drive component is positioned on a second side of the engine opposing the first side.

10. The engine system of claim 1, where the cam phaser is configured to receive control signals triggering cam phase adjustment from an electronic engine controller.

11. The engine system of claim 1, where the drive component is positioned adjacent to a frame rail.

12. The engine system of claim 1, where the cam phaser is positioned vertically above a transmission.

13. The engine system of claim 1, where the drive component is enclosed by a front engine cover.

14. A method for operation of a cam phaser system, comprising:

transferring rotational energy from a crankshaft to a cam sprocket; and transferring rotational energy from the cam sprocket to a cam phaser through rotation of a phaser driveshaft extending an entire length through and at least partially enclosed by a hollow camshaft, the phaser driveshaft including a first end directly coupled to the cam sprocket and a second end directly coupled to a phaser driveshaft interface in the cam phaser, wherein a second end of the hollow camshaft is directly coupled to the cam phaser, and the cam phaser and the cam sprocket are positioned on opposing ends of the hollow camshaft, without any other sprocket and cam adjustment mechanisms therebetween.

15. The method of claim 14, further comprising adjusting cam timing via the cam phaser.

16. The method of claim 15, where adjusting cam timing includes altering a phase of the hollow camshaft and the phaser driveshaft.

17. The method of claim 15, where the cam phaser is adjacent to a transmission and the cam phaser is located on a rear side of an engine, adjacent to a vehicle cabin and opposite a front side of the engine.

18. A cam phaser system comprising:

a cam sprocket directly rotationally coupled to a first end of a phaser driveshaft extending through and at least partially radially enclosed by a hollow camshaft; and a cam phaser coupled to a second, opposite, end of the phaser driveshaft via a phaser driveshaft interface and coupled to a second end of the hollow camshaft via a camshaft interface, the cam phaser and the cam sprocket are positioned on opposing ends of the hollow camshaft, without any other sprocket and cam adjustment mechanisms therebetween.

19. The cam phaser system of claim 18, where the hollow camshaft and the phaser driveshaft are not directly rotationally coupled to one another.

* * * * *